United States Patent [19]

Neuenschwander

[11] 4,065,832

[45] Jan. 3, 1978

[54] APPARATUS FOR FORMING A FIBROUS STRUCTURE

[75] Inventor: Rudolf Neuenschwander, Swarthmore, Pa.

[73] Assignee: Scott Paper Company, Philadelphia, Pa.

[21] Appl. No.: 772,990

[22] Filed: Feb. 28, 1977

[51] Int. Cl.[2] ..... D04H 1/00

[52] U.S. Cl. ..... 19/156.3; 19/89

[58] Field of Search ..... 19/155–156.3, 19/88, 89; 264/91, 121; 425/80–83; 65/4 R, 9

[56] References Cited

U.S. PATENT DOCUMENTS

| | | | |
|---|---|---|---|
| 3,220,811 | 11/1965 | Schuller | 19/156.3 X |
| 3,369,276 | 2/1968 | Kalwaites | 19/161 R X |
| 3,544,414 | 12/1970 | Simison | 264/91 X |
| 3,753,271 | 8/1973 | McBean | 19/156.3 |
| 3,862,472 | 1/1975 | Norton et al. | 19/156.3 X |

FOREIGN PATENT DOCUMENTS

| | | | |
|---|---|---|---|
| 1,097,789 | 2/1955 | France | 264/121 |
| 224,188 | 2/1943 | Switzerland | 19/161 R |

*Primary Examiner*—Dorsey Newton
*Attorney, Agent, or Firm*—Martin L. Faigus; William J. Foley

[57] ABSTRACT

An apparatus and method for fluid-forming (e.g., air-forming) a fibrous structure, such as a fibrous web, employs a conveying duct through which a stream of fluid-entrained fibers is directed, and a foraminous surface intercepting the downstream end of the duct to collect the fibrous structure on its surface. The improvement resides in establishing an oblique orientation between the foraminous surface and the direction of fiber flow through the duct so that the width of the foraminous surface intercepting the open end of the duct is greater than the width of the downstream end of the duct, as measured between laterally spaced sidewalls in a direction generally normal to the direction of material flow through the duct. In accordance with this invention the width of the fibrous structure deposited on the foraminous surface is greater than the width of the stream of fluid-entrained fibers confined within the conveying duct.

13 Claims, 3 Drawing Figures

APPARATUS FOR FORMING A FIBROUS STRUCTURE

BACKGROUND OF THE INVENTION

1. Field of the Invention

This invention relates to an apparatus and method for forming a fibrous structure from a stream of fluid-entrained fibers. More specifically, this invention relates to an apparatus and method for forming a fibrous structure having a greater width than that of a fluid-fiber stream directed to a forming surface upon which the fibrous structure is formed.

2. Description of the Prior Art

In commerical web forming operations it is highy desirable to increase product output to thereby minimize the unit cost of manufacturing. This is particularly important when manufacturing single and limited use fibrous products, such as cosmetic pads, industrial towels, household towels, facial tissues, impregnated wipes, components of disposable diapers and sanitary napkins, and the like. These products must be economically manufactured so that they can be sold profitably at a price that is low enough to justify their frequent disposal.

One way of increasing product output in a web forming operation is to form the web several times wider than the desired width of the final product. The fibrous web can then be severed in laterally spaced-apart regions to form more than one final product from the initially formed web. This technique for increasing product output can be advantageously employed in the formation of single and limited use air-laid products that are intended to compete with products that are made by faster wet-forming processes.

Apparatus employed to form air-laid webs generally include a fiberizing device, such as a fiberizing roll, for separating fibers from a fibrous feed lap or mat and entraining the fibers in air to form an air suspension of the fibers. The air suspension of fibers is then directed through an upstream end of a conveying duct toward a moving foraminous forming surface which intercepts a downstream open end of the duct. The air from the suspension is directed through the forming surface, and the fibers are condensed upon the surface to form the air-laid fibrous web. Most preferably, a partial vacuum is established behind the forming surface to aid in directing the suspension of fibers toward the forming surface to form the web. Quite often the formed web is subjected to post-treatment operations; such as embossing, adhesive bonding and the like; to impart desired properties to said webs, and ultimately to the finished product.

It has been suggested in the prior art to increase the width of web formation by employing flow-spreading duct work having diverging sidewalls to increase the width of fiber flow. In order to aid in the flow spreading function prior art flow-spreaders have included laterally spaced-apart vanes, flow throttling diaphragms and similar structures to attempt to maintain lateral uniformity of the flow as it is spread. These techniques have not been entirely satisfactory, and nonuniformities of flow created by the lateral spreading operation have been manifested in undesirable basis weight variations across the width of the formed fibrous structures. Accordingly, it is believed to be highly desirable to accomplish the flow spreading function with a minimum of lateral movement of the air-suspension of fibers. The instant invention provides such a function.

Air-forming apparatus and methods for forming fibrous webs of varying widths are also known in the prior art. For example, see U.S. Pat. Nos. 3,753,271, issued to McBean and 3,844,751, issued to Stewart. Both of these latter patents provide for the variable orientation of a conveying duct relative to a forming wire to vary the width of the formed web. However, in accordance with the techniques disclosed in both of these prior art patents, the width of the formed fibrous structure can be no greater than the maximum spacing between laterally spaced-apart walls of the conveying duct through which the fibers are conveyed. Therefore, if it is desired to form a web having a greater width than the maximum dimension of the forming duct, it is necessary to utilize multiple air-forming devices in combination with each other, as disclosed in the Stewart patent. Obviously it would be simpler and more economical to achieve wide web formation with a single air-forming device, as opposed to multiple devices.

In the U.S. Pat. No. 3,753,271 to McBean, a fiberizing roll is rotated at a relatively high speed to separate fibers from a feed mat. The axial dimension of the fiberizing roll in the McBean device must be close to the maximum web width that one desires to form on the apparatus. However, the larger the roll employed, the more cumbersome and expensive the equipment becomes. Therefore, it is highly desirable to be able to reduce the width of the fiberizing roll without sacrificing web width. The instant invention is directed to a method and apparatus which can be employed to achieve this objective.

SUMMARY OF THE INVENTION

In accordance with the apparatus and method of this invention a fluid suspension of fibers is directed through a conveying duct which is intercepted by a movable foraminous surface. The fluid from the suspension passes through the foraminous surface, generally with the air of a pressure drop established through that surface, and the fibers in the suspension are laid on the surface, preferably in the form of a fibrous web or batt structure. The improvement resides in establishing an oblique orientation between the foraminous surface and the general direction of fluid-fiber flow through the conveying duct such that the width of the foraminous surface intercepting the downstream end of the conveying duct between laterally spaced-apart duct walls is greater than the width of the duct between the laterally spaced-apart duct walls, as measured generally perpendicular to the direction of material flow through said duct. As a result of this invention the width of fiber deposition on the foraminous surface is greater than the lateral, or cross-machine-direction dimension of the conveying duct, as measured generally normal to the direction of fiber flow through said duct.

The present invention is believed to be highly desirable for use in processes employed to form air-laid fibrous structures within a wide basis weight range (e.g. 1 oz./yd.$^2$ to about 50 oz./yd.$^2$). It is generally desirable to form the air-laid structures from a high percentage of relatively inexpensive fibers, such as wood pulp fibers or cotton linters. These fibers are also highly absorbent, and therefore are well suited for use in air-laid products intended to be employed in absorbent applications. These fibers are also quite short; being under ¼ inch in length. If desired, or necessary, a minor percentage, by weight, of longer textile-length fibers can be included in the air-laid structure to add reenforcement.

A suitable process for forming an air-laid web of blended long and short fibers is disclosed in U.S. Pat. No. 3,862,742, issued to Norton et al and assigned to Scott Paper Company. The present invention can be employed to increase the width of formation of the loosely compacted short fiber batt employed in the process disclosed in the Norton et al patent. The Norton et al patent is incorporated by reference into this application.

Apparatus employed in the air-lay formation of fibrous web structures commonly include a fiberizing roll to separate fibers from a feed mat for subsequent direction through the conveying duct. Such a fiberizing roll generally has an axial dimension approximately equal to the duct width. Thus, in accordance with this invention, the axial dimension of the fiberizing roll, like the duct width, is less than the width of the fibrous structure deposited on the foraminous surface. Therefore, in the formation of a fibrous structure of a particular width, the present invention permits the use of a narrower fiberizing roll than is employed in prior art devices. The use of a narrower fiberizing roll generally results in a simpler and less costly construction.

In the preferred forms of this invention the air stream of suspended fibers is directed in a substantially linear direction toward the obliquely oriented forming surface, and the air is directed through the forming surface in the same linear direction it followed through the duct. Applicant has found that controlling the flow in this manner results in good basis weight uniformity in the width-wise direction of the formed fibrous structure. After passing through the forming surface the air is either removed from the system or recirculated into the inlet side of the conveying duct for use in entraining additional fibers.

Preferably the laterally spaced sidewalls of the duct are either substantially parallel to each other, or only slightly diverge or converge in the direction of material flow. Regardless of the particular orientation of the duct sidewalls, the duct is not employed to laterally spread the flow of fibers to the desired web width. In other words, the width-wise movement of fibers within the duct is generally insignificant, and does not create a problem in maintaining fiber uniformity within the air stream. Preferably the angle between the laterally spaced sidewalls, as measured in the direction of material flow through the duct, is between about 2° convergence and about 2° divergence. Most preferably the sidewalls are parallel to each other.

At the time of conception of this invention it was believed that a significant problem might exist in achieving uniformity of fiber deposition on a foraminous surface having a significant oblique orientation (e.g. $\alpha = 50°$ or less) to the conveying duct. Specifically, it was thought that fibers might roll along the obliquely oriented surface and pile up adjacent one side margin of the duct. Quite surprisingly applicant found that good lateral uniformity of fiber deposition could be achieved on the obliquely oriented surface.

Other objects and advantages of this invention will become apparent upon referring to the detailed description which follows, taken in conjunction with the drawings.

DESCRIPTION OF THE PREFERRED EMBODIMENTS OF THE INVENTION

Figure 3:
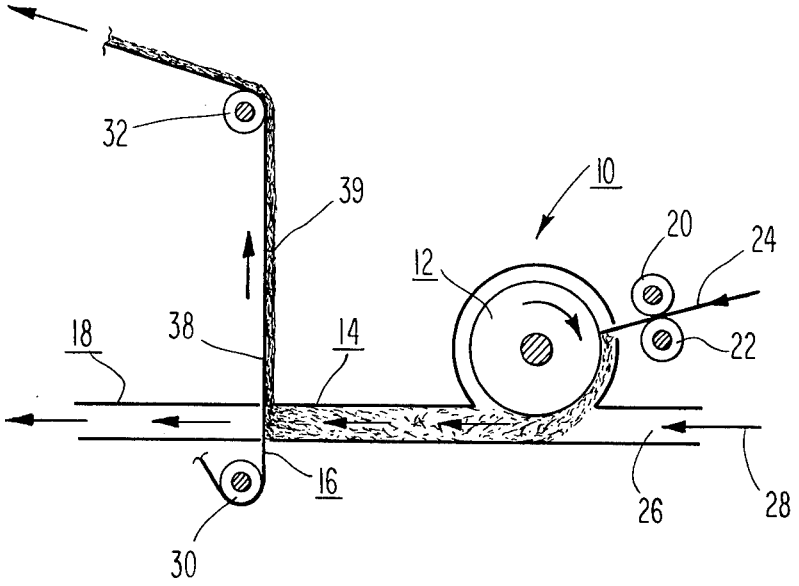
FIG. 3 is a local sectional view taken generally along 3—3 of FIG. 1, and showing fibers deposited on a foraminous surface.

Referring to FIG. 3, the apparatus 10 in accordance with the preferred embodiment of this invention, is an air-lay apparatus including a fiberizing roll 12, a conveying duct 14, a foraminous member 16 and a vacuum box 18. In this embodiment of the invention the foraminous member 16 is in the form of an endless wire upon which a fibrous structure is to be formed.

Upper and lower feed rolls 20 and 22 are positively driven by any conventional drive means (not shown) to direct a fibrous feed mat 24 into engagement with the periphery of the fiberizing roll 12. The fiberizing roll is rotated to separate fibers from the feed mat and direct them in an air stream through the conveying duct 14. Air is directed into the conveying duct 14 through an inlet passageway 26 in the direction indicated by arrow 28. The air can be directed into the inlet passageway 26 by a suitable fan (not shown) that is also connected to the vacuum box 18 for establishing a pressure drop across the forming wire 16. The pressure drop established through the forming wire aids in directing the air-suspension of fibers through the conveying duct 14 to deposit the fibers on a surface of the wire. The air in which the fibers are entrained can be directed through the vacuum box and recirculated through the inlet passageway 26. The specific elements described thus far are conventionally employed in fiberizing apparatus; the improvement of this invention residing in the specific orientation of the elements to achieve a unique result which has not been accomplished in the prior art.

Figure 1:
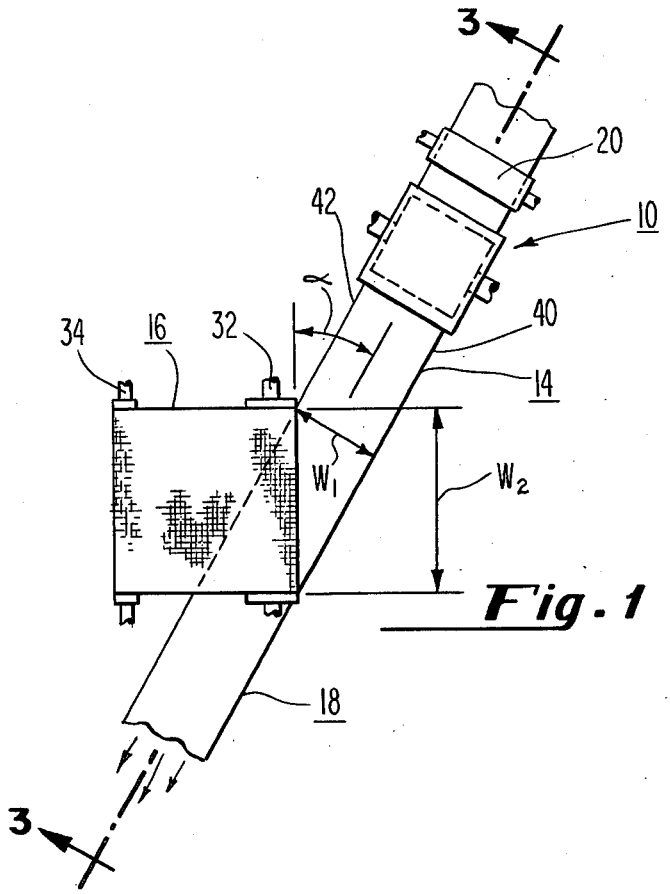
FIG. 1 is a schematic plan view of an apparatus employed in accordance with one embodiment of this invention.
Figure 2:
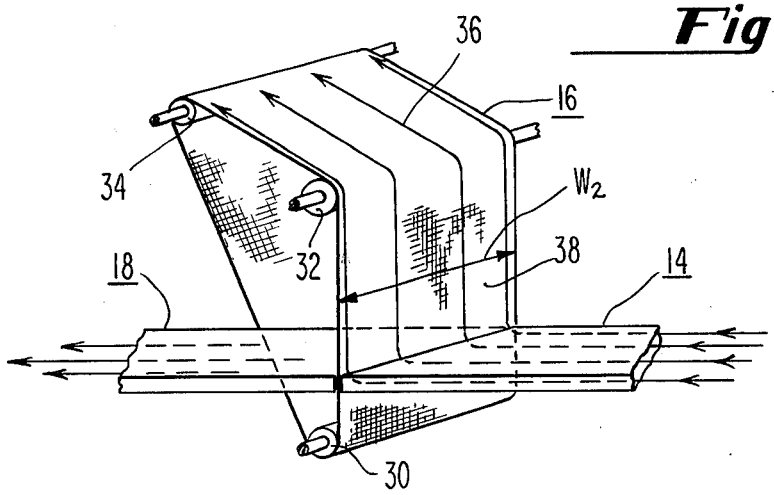
FIG. 2 is a schematic isometric view of the apparatus shown in FIG. 1 with the fiberizing section omitted.

Referring specifically to FIGS. 1 and 2, the present invention broadly resides in a unique geometric orientation between the forming wire 16 and the conveying duct 14. The forming wire 16 is trained about rolls 30, 32 and 34. At least one of these rolls is positively driven by conventional drive means (not shown) to move the endless forming wire 16 in the direction of arrow 36. The forming wire includes a linear segment 38 disposed between the spaced-apart rolls 30 and 32, and this linear segment intercepts the downstream open end of the conveying duct 14. Accordingly, a fibrous structure 39 formed in accordance with this invention is deposited on the linear segment 38 (FIG. 3). In the embodiment shown the linear segment 38 is moved past the duct substantially perpendicular (i.e. 90°) to the direction of fiber flow through said duct. However, for forming some types of web structures it might be desirable to tilt the segment 38 at an angle other than 90° relative to the direction of the fiber flow through the duct.

In accordance with this invention the spaced-apart rolls 30 and 32, along with the linear segment 38 of the forming wire 16, are oriented at an oblique angle $\alpha$ relative to the general direction of fiber flow through the conveying duct 14 (FIG. 1). In the preferred embodiment of the invention the general direction of fiber flow is substantially parallel to the longitudinal axis of the conveying duct.

As can be seen best in FIG. 1, the width of the conveying duct $W_1$ is the distance between laterally spaced-apart sidewalls 40 and 42 adjacent the downstream end of said duct and in a direction generally normal to the direction of material flow through said duct. As can be seen in FIGS. 1 and 2 the duct width $W_1$ is less than the width, $W_2$, of the surface of the linear wire segment 38 intercepting the downstream end of the conveying duct between the duct walls 40 and 42. Accordingly, the fibrous web structure 39 which is formed on the foraminous wire 16 is wider than the width of the air-entrained fibers in the conveying duct 14. Note that the web 39 is formed without employing conventional flow-spreading systems between the conveying duct 14 and the forming wire 16. In other words, it is not necessary to move the air-entrained stream of fibers perpendicular to the downstream direction of material flow in order to form a web that is wider than the confined flow of fibers in the duct 14. This eliminates the disadvantages associated with the conventional flow spreading systems described earlier in this application.

Referring to FIG. 1, the width $W_2$ of the wire in the region between the laterally spaced-apart duct sidewalls 40 and 42 is generally the same as the width of the fibrous structure 39 formed on said wire, and is calculated by the following formula:

$$W_2 = W_1/\text{sine } \alpha ;$$

wherein $W_2$ is the width of the forming wire 16 between the laterally spaced-apart duct sidewalls 40 and 42;

$W_1$ is the width of the conveying duct 14 adjacent its downstream end, as measured between the laterally spaced-apart sidewalls 40 and 42 in a direction generally normal to the direction of material flow through the duct; and $\alpha$ is the included angle between the oblique orientation of the linear segment 38 of the forming wire 16 and the general direction of material flow through the conveying duct (see FIG. 1).

In the preferred embodiment of this invention the laterally spaced-apart duct walls 40 and 42 are symmetrically disposed on opposite sides of a central duct axis, and preferably are parallel to each other. In this preferred embodiment of the invention the angle $\alpha$ can be measured between the central axis of the duct and the lateral direction of the obliquely oriented linear segment 38 of the forming wire 16. The latter direction corresponds to the direction of orientation of the rotational axes of the rolls 30, 32 and 34.

As can be seen best in FIGS. 1 and 2, the flow of air is directed through the linear segment 38 of the forming wire 16 in the same linear direction as the air suspension of fibers is directed through the conveying duct 14 from the entrance end thereof (i.e., the end of the duct adjacent the fiberizing roll 12). Accordingly, it is not necessary to divert the direction of movement of the air stream in which the fibers are entrained, and this enhances the ability of achieving a substantially uniform width-wise deposition of fibrous material on the linear segment 38 of the wire 16.

If desired a transfer conveyor (not shown) can be positioned adjacent the roll 34 to receive the fibrous structure 39, and to transport it to other areas, as desired. For example, the fibrous structure 39 could be directed to subsequent post-treatment operations, such as embossing and adhesive application. It should be understood that the particular manner in which the fibrous structure 39 is handled does not constitute a limitation on the present invention.

It is also within the scope of this invention to deposit the fibers on a foraminous member other than a continuous wire. For example, the conveying duct 14 could be intercepted by an obliquely oriented cylindrical roll having a foraminous periphery. The interior of the roll could include a stationary vacuum compartment having an inlet aligned with the passage of the conveying duct for use in establishing a pressure drop across the roll periphery to aid in directing the air suspension of fibers toward said periphery. Cylindrical rolls of the above construction are widely known in the air-lay field, and no further description is considered to be necessary.

Most preferably the oblique orientation between the foraminous member and the conveying duct is established to provide for the formation of a fibrous structure having a width $W_2$ which is at least 20% greater than the width $W_1$ of the forming duct. In one mode of operation the angle $\alpha$ between the foraminous forming wire 16 and the conveying duct 14 was set at 30° to form a fibrous structure having a width twice that of the forming duct width. As mentioned earlier, this increased width of formation is achieved without the lateral spreading of the flow of air-entrained fibers as is required when using conventional flow spreaders. Moreover, this invention permits the formation of a fibrous structure having a width which is considerably greater than the width of the upstream end of the conveying duct. Accordingly, the axial dimension of a fiberizing roll, which only need be as long as the duct width, can be considerably narrower than the ultimate dimension of the fibrous structure that is to be formed.

Having described my invention, I claim:

1. An apparatus for use in the formation of a fibrous structure by entraining fibers in a fluid at an upstream end of a conveying duct, said conveying duct having laterally spaced-apart sidewalls, directing the fluid-entrained fibers in a downstream direction through the conveying duct to an open downstream end thereof and intercepting the open downstream end of the duct with a movable foraminous surface to collect the fibers on said surface in the form of a fibrous structure; the improvement wherein the foraminous surface is obliquely oriented to the direction of fiber flow through said duct so that the downstream distance of fiber flow from the upstream end of the duct to the point at which the flow is intercepted by the foraminous surface is greater adjacent one duct sidewall than adjacent the other duct sidewall whereby the lateral dimension of the foraminous surface between the laterally spaced-apart duct sidewalls is greater than the width of the duct at its open downstream end, as measured between said duct sidewalls in a direction generally normal to the direction of fiber flow through said duct.

2. The apparatus according to claim 1, wherein the conveying duct directs the suspension of fibers in a generally linear flow path to its open end which is intercepted by the obliquely oriented foraminous surface, including a vacuum source having a passageway through which a pressure drop across the foraminous surface can be established, said passageway constituting a straght line extension of the conveying duct to direct the fluid of the suspension through the foraminous surface along the same linear flow path of the suspension of fibers through said conveying duct.

3. The apparatus according to claim 1, including a fiberizing means adjacent an upstream end of the conveying duct for separating fibers from a fibrous feed, the laterally spaced-apart sidewalls of said duct being substantially planar from a region adjacent the fiberizing means to a downstream region adjacent the obliquely oriented surface.

4. The apparatus according to claim 3, wherein the laterally spaced-apart sidewalls are substantially parallel to each other.

5. The apparatus of claim 1, wherein the foraminous surface is the surface of a wire.

6. The apparatus according to claim 1, wherein the foraminous surface is the outer periphery of a roll.

7. The apparatus according to claim 1, wherein the lateral dimension of the foraminous surface between the laterally spaced-apart duct sidewalls is at least 20% greater than the width of the duct at its opened end, as measured between said sidewalls in the direction generally normal to the direction of fiber flow through the duct.

8. An apparatus for use in forming a fibrous structure, said apparatus including a conveying duct for directing a stream of fluid-entrained fibers in a downstream direction to an exit end of said duct; said duct including a top wall, a bottom wall and laterally spaced-apart sidewalls; a movable foraminous surface for intercepting the duct adjacent the exit end thereof for permitting the fluid in which the fibers are entrained to pass through it, and for collecting the fibers on its surface in the form of a fibrous structure; the improvement wherein one sidewall of the conveying duct has a downstream end which extends beyond the downstream end of the other sidewall, said foraminous surface being obliquely oriented so as to be closely positioned to the downstream ends of both sidewalls to present a width for intercepting the stream of fluid-entrained fibers that is greater than the width of the conveying duct at its exit end, as measured generally perpendicular to the direction of material flow through said duct.

9. The apparatus according to claim 8, wherein the foraminous surface is the surface of a wire.

10. The apparatus according to claim 8, wherein the foraminous surface is the outer periphery of a roll.

11. The apparatus according to claim 8, wherein the lateral dimension of the foraminous surface between the laterally spaced-apart duct sidewalls is at least 20° greater than the width of the duct at its open end, as measured between said sidewalls in the direction generally normal to the direction of fiber flow through the duct.

12. An apparatus for use in the formation of a fibrous structure, said apparatus including a fiberizing means for entraining fibers in a fluid medium, a conveying duct with laterally spaced-apart sidewalls having an upstream end adjacent the fiberizing means for receiving the fluid-entrained fibers, and a movable foraminous surface intercepting an open downstream end of the conveying duct to collect the fibers on said surface in the form of fibrous structure; the improvement wherein the foraminous surface is obliquely oriented to the direction of fiber flow through said duct so that said surface intercepts the fiber flow closer to the fiberizing means adjacent one lateral wall of said duct than adjacent the other lateral wall of said duct, whereby the lateral dimension of the foraminous surface between the laterally spaced-apart duct sidewalls is greater than the width of the duct at its open downstream end, as measured between said sidewalls in a direction generally normal to the direction of fiber flow through said duct.

13. The apparatus according to claim 12 wherein the fiberizing means is a rotatable fiberizing roll.

* * * * *